US008537144B2

(12) United States Patent
Matthijs et al.

(10) Patent No.: US 8,537,144 B2
(45) Date of Patent: Sep. 17, 2013

(54) METHOD AND DEVICE FOR AVOIDING IMAGE MISINTERPRETATION DUE TO DEFECTIVE PIXELS IN A MATRIX DISPLAY

(75) Inventors: Paul Matthijs, Eke (BE); Tom Kimpe, Ghent (BE)

(73) Assignee: Barco N.V., Kortrijk (BE)

( * ) Notice: Subject to any disclaimer, the term of this patent is extended or adjusted under 35 U.S.C. 154(b) by 1658 days.

(21) Appl. No.: 10/719,881

(22) Filed: Nov. 21, 2003

(65) Prior Publication Data

US 2004/0174320 A1 Sep. 9, 2004

Related U.S. Application Data

(60) Provisional application No. 60/430,036, filed on Nov. 29, 2002.

(30) Foreign Application Priority Data

Nov. 29, 2002 (EP) ..... 02447234

(51) Int. Cl.
*G09G 5/00* (2006.01)

(52) U.S. Cl.
USPC ..... 345/204; 345/76; 345/87

(58) Field of Classification Search
USPC ..... 345/76–78, 55, 81, 83, 87–88, 92–94, 345/204, 207–208, 690, 697–699, 904
See application file for complete search history.

(56) References Cited

U.S. PATENT DOCUMENTS

| | | | | |
|---|---|---|---|---|
| 4,748,507 | A * | 5/1988 | Gural | 348/219.1 |
| 5,289,174 | A * | 2/1994 | Suzuki | 345/98 |
| 5,982,946 | A * | 11/1999 | Murakami | 382/272 |
| 6,014,471 | A * | 1/2000 | Barkan et al. | 382/275 |
| 6,529,618 | B1 * | 3/2003 | Ohara et al. | 382/132 |
| 6,806,870 | B1 * | 10/2004 | Takanashi | 345/207 |
| 7,061,533 | B1 * | 6/2006 | Urushiya | 348/346 |
| 2001/0035853 | A1 * | 11/2001 | Hoelen et al. | 345/102 |
| 2002/0000983 | A1 * | 1/2002 | Lee et al. | 345/204 |
| 2002/0105579 | A1 * | 8/2002 | Levine et al. | 348/187 |
| 2004/0164939 | A1 * | 8/2004 | Johnson et al. | 345/82 |

FOREIGN PATENT DOCUMENTS

| | | | |
|---|---|---|---|
| EP | 0984393 | A2 | 3/2000 |
| JP | 59126967 | A * | 7/1984 |

OTHER PUBLICATIONS

Invitation in corresponding EP02447234.2, dated Aug. 29, 2011.
Communication of Jan. 14, 2011 in Taiwan application 092132979, and translation of Official Letter.
Examination report dated Jun. 25, 2012 in EP02447234.2.

* cited by examiner

*Primary Examiner* — Stephen Sherman
(74) *Attorney, Agent, or Firm* — Barnes & Thornburg LLP

(57) ABSTRACT

The present invention relates to a system and a method for avoiding misinterpretation of images due to defective pixels present in matrix addressed electronic displays during display time. This may be very important e.g. in the medical world. The method comprises obtaining information on the presence of the defective pixels in the display, and modulating the operation of the display so as to indicate, emphasize or warn for the presence of said defective pixels on the actual display having defect pixels, or adapting the image content of the defective pixels or of pixels in the neighborhood of the defective pixels so as to indicate, emphasize or warn for the presence of said defective pixels in a copy of the displayed image. Such copy may be a hard copy or an electronic copy.

A corresponding device is also provided.

17 Claims, 5 Drawing Sheets

Fig. 5a
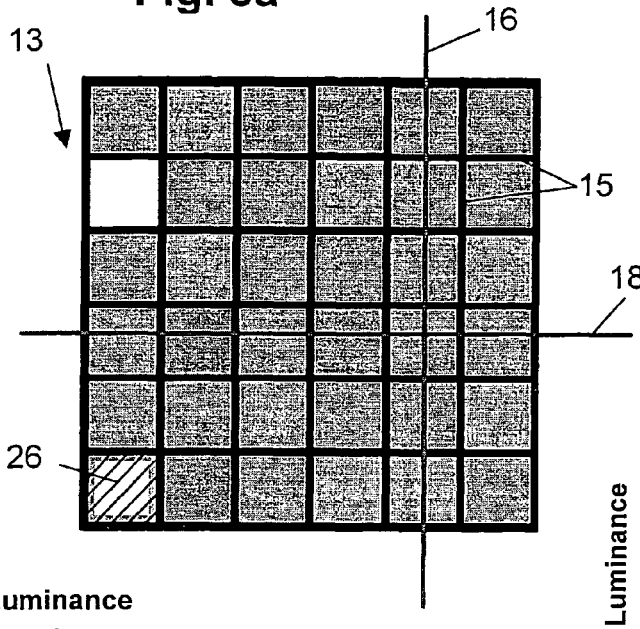
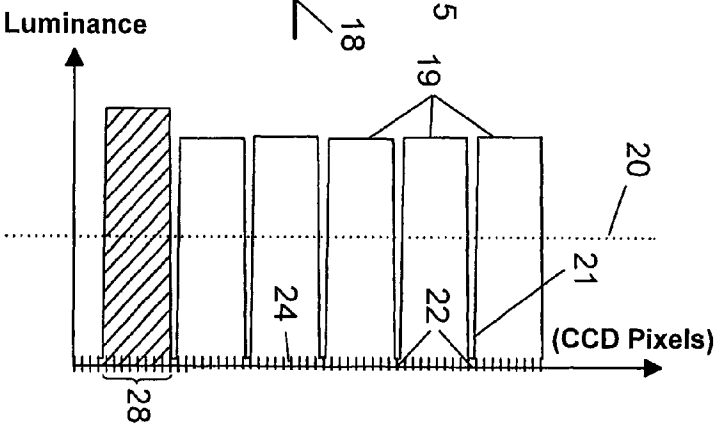
Fig. 5c
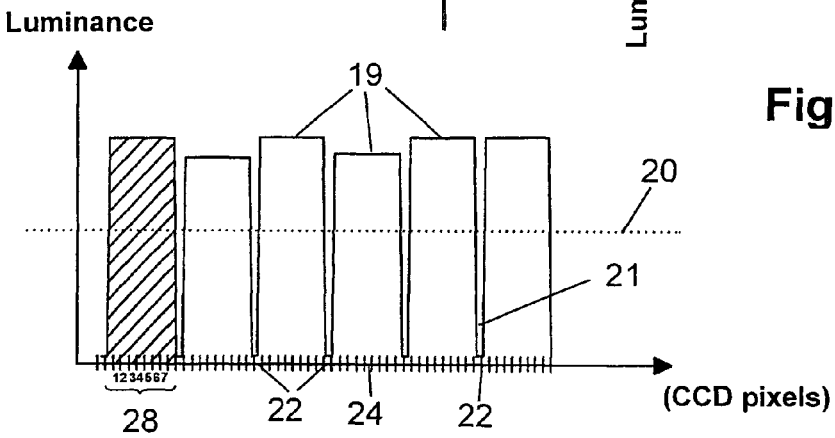
Fig. 5b
Fig. 5

| | | | | |
|---|---|---|---|---|
| A | C | A | C | ... |
| B | D | B | D | ... |
| A | C | A | C | ... |
| B | D | B | D | ... |
| A | C | A | C | ... |
| B | D | B | D | ... |
| ... | ... | ... | ... | ... |

METHOD AND DEVICE FOR AVOIDING IMAGE MISINTERPRETATION DUE TO DEFECTIVE PIXELS IN A MATRIX DISPLAY

RELATED APPLICATION

This application is the nonprovisional filing of provisional application No. 60/430,036, filed Nov. 29, 2002.

TECHNICAL FIELD OF THE INVENTION

The present invention relates to a system and a method for avoiding misinterpretation of images due to defective pixels present in matrix addressed electronic displays during display time such as fixed format displays e.g. plasma displays field emission displays, liquid crystal displays, EL-displays, LED and OLED displays, especially flat panel displays as used in projection or direct viewing concepts.

By a defective pixel is meant a pixel that always shows the same luminance (for instance, but not limited to, always black or always full white) and/or colour behaviour independent of the luminance stimulus applied to it, or shows a luminance or colour behaviour that shows a severe distortion compared to non-defective pixels of the display. For example a pixel that reacts to an applied drive signal, but that has a luminance behaviour that is very different from the luminance behaviour of neighbouring pixels, for instance significantly more dark or bright than surrounding pixels, can be considered a defect pixel. Also pixels that are located on a wrong place can be considered as defective pixels.

The present invention applies to emissive, transmissive, reflective and trans-reflective display technologies fulfilling the feature that each pixel is individually addressable.

BACKGROUND OF THE INVENTION

At present, most matrix based display technologies are in its technological infancy compared to long established electronic image forming technologies such as Cathode Ray Tubes. As a result, many domains of image quality deficiency still exist and cause problems for the acceptance of these technologies in certain applications.

Matrix based or matrix addressed displays are composed of individual image forming elements, called pixels (Picture Elements), that can be driven (or addressed) individually by proper driving electronics. The driving signals can switch a pixel to a first state, the on-state (luminance emitted, transmitted or reflected), to a second state, the off-state (no luminance emitted, transmitted or reflected), see for example EP-117335 which describes an LCD. For some displays, one intermediate state between the first and the second state is used—see EP-462619 which also describes an LCD. For still other displays, one or more intermediate states between the first and the second state (modulation of the amount of luminance emitted, transmitted or reflected) are used—see EP-117335.

Matrix addressed displays are typically composed of many millions of pixels and very often pixels exist that are stuck in a certain state (on, off or anything in between). Where sub-pixel elements are individually controllable then one of the sub-pixel elements may become stuck in a certain state. For example, a pixel structure may comprise three sub-pixel elements for red, green and blue colours. If one of these sub-pixels becomes stuck, then the pixel structure has a permanent colour shift. Mostly such problems are due to a malfunction in the driving electronics of the individual pixel (for instance a defect transistor). Other possible causes are problems with various production processes involved in the manufacturing of the displays, and/or by the physical construction of these displays, each of them being different dependent on the type of technology of the electronic display under consideration. It is also possible that a pixel or sub-pixel element is not really stuck in a state, but shows a luminance or colour behaviour that is significantly different from the pixels or sub-pixels in its neighbourhood. For instance but not limited to a defective pixel shows a luminance behaviour that differs more than 20% (at one or more video-levels) from the pixels in its neighbourhood, or a defective pixel shows a dynamic range (maximum luminance/minimum luminance) that differs more than 15% from the dynamic range of pixels in its neighbourhood, or a defective pixel shows a colour shift greater than a certain value comparing to an average or desired value for the display. Of course other rules are possible to determine if a pixel or sub-pixel is defective or not (any condition that has a potential danger for image misinterpretation can be expressed in a rule to determine whether a pixel is a defective pixel). The exact reason for a defective pixel is not important for the present invention.

Defective pixels are very visible for a user of the display. This not only can be very disturbing for the user, but it can also result in wrong interpretation of the image being displayed. For applications where image fidelity is required to be high, such as for example in medical applications, this situation is unacceptable.

U.S. Pat. No. 5,504,504 describes a method to make some classes of defective pixels less visible by changing the luminance of pixels in the neighbourhood of the defective pixel. This, however, distorts the luminance of the whole image, and is not generally accepted in the medical world when viewing medical images.

In prior art devices, some classes of defective pixels are located and burnt down so as to always appear black and thus less visible to a user. This solution, however, has the disadvantage that, e.g. in medical images, a black pixel in a region of interest for a radiologist might indicate (or hide) for example a pathological defect such as tumour cells, Therefore, there is a danger in such a situation that a radiologist will not be able to discriminate between the defective pixel and a feature of therapeutic relevance.

SUMMARY OF THE INVENTION

It is an object of the present invention to provide a method and device for avoiding misinterpretation of images due to the "defective pixels" described above. It is not a necessary intention to correct the defect pixels itself.

The above objectives is accomplished by a method and device according to the present invention.

The present invention provides a method for avoiding misinterpretation of an image displayed on a matrix display due to defectives pixels in the matrix display. This may be very important e.g. in the medical world. The method comprises obtaining information on the presence of the defective pixels in the display, and modulating the operation of the display so as to indicate, emphasise or warn for the presence of said defective pixels on the actual display having defect pixels, or adapting the image content of the defective pixels or of pixels in the neighbourhood of the defective pixels so as to indicate, emphasise or warn for the presence of said defective pixels in a copy of the displayed image. Such copy may be a hard copy or an electronic copy.

The information on the presence of defective pixels in the display may be obtained from data previously stored in a memory device.

A method according to an the present invention comprises, while displaying the image on the matrix display, supplying information on defective pixels to a user, based on the stored data.

A method according to an embodiment of the present invention comprises visually marking the at least one defective pixel on the display in order to indicate, emphasise or warn its presence. This may e.g. be done highlighting the defective pixel by changing the drive signal of neighbouring pixels.

A method according to an embodiment of the present invention may furthermore comprise shifting, rotating or flipping the displayed image so that defective pixels are not located in a region of interest. The method may also comprise shifting, rotating or flipping the displayed image so that a defective pixel is located in a flat image area, i.e. in an area of the image where there are not a lot of image transitions.

A method according to an embodiment of the present invention may furthermore comprise, before modulating the operation of the display, selection of a desired indication method, i.e. for example making all pixels around a defective pixel white (luminance high), so as to obtain a kind of circle around the defective pixel, or making the pixels around the defective pixel blink (driving it with e.g. subsequent drive levels corresponding to a first, e.g. black, output level, and to a second, e.g. white, output level).

The information on the presence of defective pixels is obtained by means of an image capturing device such as a flatbed scanner, a camera, a CCD or a photodiode.

The present invention also provides a device for avoiding misinterpretation of an image displayed on a matrix display due to defective pixels in the matrix display. The device comprises an information retrieval device for obtaining information on the presence of the defective pixels in the display, and a modulating device for modulating the operation of the display so as to indicate, emphasise or warn for the presence of said defective pixels on the actual display having defect pixels, or for adapting the image content of the defective pixels or of pixels in the neighbourhood of the defective pixels so as to indicate, emphasise or warn for the presence of said defective pixels in a copy of the displayed image.

The information retrieval device may comprise a memory device where defective pixel information data is stored. The device for avoiding misinterpretation may comprise an information supply device for supplying information on defective pixels to a user, based on the stored data, while displaying the image on the matrix display.

The information retrieval device may furthermore comprise marking means for visually marking the defective pixels on the display. The marking means may comprise a driving means for changing the drive signal of pixels neighbouring the defective pixel.

The information retrieval device may furthermore comprise a shifting device for shifting, rotating or flipping the displayed image so that defective pixels are not located in a region of interest. It may also comprise a shifting device for shifting, rotating or flipping the displayed image so that a defective pixel is located in a flat image area, i.e. in an area of the image where there are not a lot of image transitions.

The information retrieval device may furthermore comprise selection means for selecting a desired modulation method.

The information retrieval device may furthermore comprise an image capturing device for capturing images from individual display pixels, such as a scanner, a camera, a CCD or a photodiode.

The present invention also provides a control unit for use with a device for avoiding misinterpretation of an image displayed on a matrix display, due to defective pixels in the matrix display. The control unit is adapted for controlling the obtaining of information on the presence and characteristics of the defect pixels in the display, and for controlling modulation of the operation of the display so as to indicate, emphasise or warn for the presence of said defective pixels on the actual display having defect pixels, or adaptation of the image content of the defective pixels or of pixels in the neighbourhood of the defective pixels so as to indicate, emphasise or warn for the presence of said defective pixels in a copy of the displayed image.

The present invention also provides a computer program product for executing any of the methods according to the present invention when executed on a computing device associated with a system for avoiding misinterpretation of an image displayed on a matrix display, due to defective pixels in the matrix display.

The present invention furthermore provides a machine readable data storage device storing the computer program product according to the present invention.

The present invention also provides transmission of the computer program product of the present invention over a local or wide area telecommunications network.

The present invention also provides an electronic data format that can be retrieved from a hardcopy, softcopy or electronic medium and that allows:

- to identify a data set with respect to its applicability to the actual target display having defect pixels, or in other words, the data set is for use only on that single display device on which the defects are characterised by a method according to the present invention,
- to indicate the position of the defect pixels on the actual display having defect pixels, and
- to reconstruct or simulate the position of the defect pixels on copy of the image rendered on a hardcopy or a softcopy on an electronic display device.

The present invention does not necessarily repair the defective pixels but rather carries out corrective actions so as to avoid wrong image interpretation. This may be done, according to an embodiment of the present invention, by warning the user of the display that defective pixels are present in the display, by notifying the location of defective pixels, for instance by generating a report or by marking them visually on the display, on demand of the user or automatically. A quality system according to the present invention is also able to take corrective actions to avoid misinterpretation of the image, on the basis of the notified location of the defective pixels. According to another embodiment, the misinterpretation may be avoided by shifting, rotating or flipping the image so that no defective pixel is located in an area of interest.

These and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 5 schematically illustrates an embodiment of an algorithm to identify matrix display pixel locations.

Figure 1:
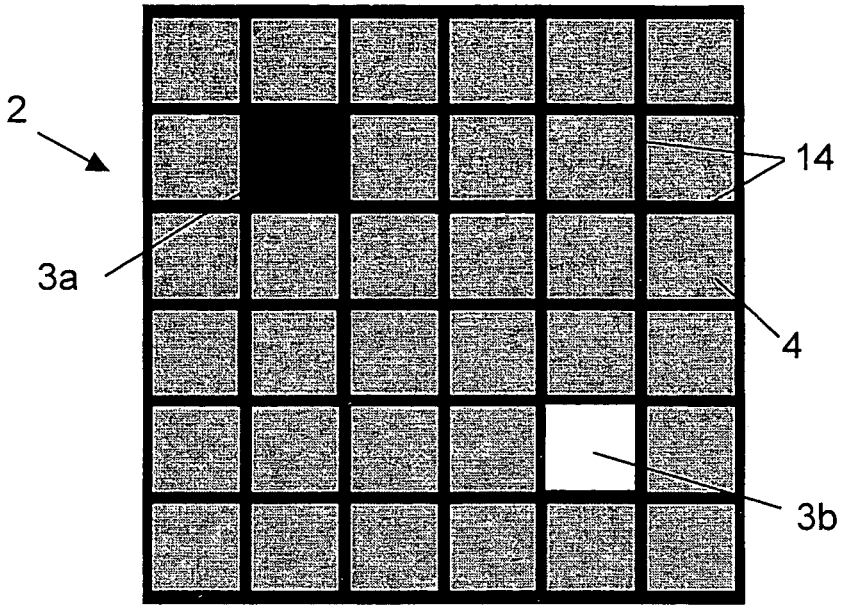
FIG. 1 illustrates a grey scale matrix display having two defect pixels, all pixels having an equal driving signal.

In the different figures, the same reference figures refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps.

The invention will be described with reference to flat panel displays but is not limited thereto. It is understood that a flat panel display does not have to be exactly flat but includes shaped or bent panels. A flat panel display differs from displays such as a cathode ray tube in that it comprises a matrix or array of "cells" or "pixels" each producing or controlling light over a small area. Arrays of this kind are called fixed format arrays. There is a relationship between the pixel of an image to be displayed and a cell of the display. Usually this is a one-to-one relationship. Each cell may be addressed and driven separately. It is not considered a limitation on the present invention whether the flat panel displays are active or passive matrix devices. The array of cells is usually in rows and columns but the present invention is not limited thereto but may include any arrangement, e.g. polar or hexagonal. The invention will mainly be described with respect to liquid crystal displays but the present invention is more widely applicable to flat panel displays of different types, such as plasma displays, filed emission displays, EL-displays, OLED displays, etc. In particular the present invention relates not only to displays having an array of light emitting elements but also displays having arrays of light emitting devices, whereby each device is made up of a number of individual elements. The displays, may be emissive, transmissive, reflective, or trans-reflective displays.

Further the method of addressing and driving the pixel elements of an array is not considered a limitation on the invention. Typically, each pixel element is addressed by means wiring but other methods are known and are useful with the invention, e.g. plasma discharge addressing (as disclosed in U.S. Pat. No. 6,089,739) or CRT addressing.

A matrix addressed display 2 comprises individual pixels 4. These pixels 4 can take all kinds of shapes, e.g. they can take the forms of characters. The examples of matrix displays 2 given in FIG. 1 and FIG. 2 have rectangular or square pixels 4 arranged in rows an columns. FIG. 1 illustrates the image of a display 2 with two defective pixels (one pixel 3*a* is stuck in a dark state and another pixel 3*b* is stuck in a bright state). Every pixel 4 is driven with the same signal. Except for the defective pixels 3*a*, 3*b*, all pixels have the same luminance output level. The spatial distribution of the defect pixels 3*a*, 3*b* is arbitrary, as can be seen.

In order to be able to avoid misinterpretation of the image due to defective pixels, in first instance the location of the defective pixels has to be known, and thus detected.

The present invention provides a vision measurement system, a set-up for automated, electronic vision of the individual pixels of the matrix addressed display, i.e. for measuring the colour or luminance emitted or reflected (depending on the type of display) by individual pixels 4, using a vision measurement set-up. The vision measurement system comprises an image capturing device 6, 12 and possibly a movement device 5 for moving the image capturing device 6, 12 and the display 2 with respect to each other. Two embodiments are given as an example, although other electronic vision implementations may be possible reaching the same result an electronic image of the pixels 4.

Figure 3:
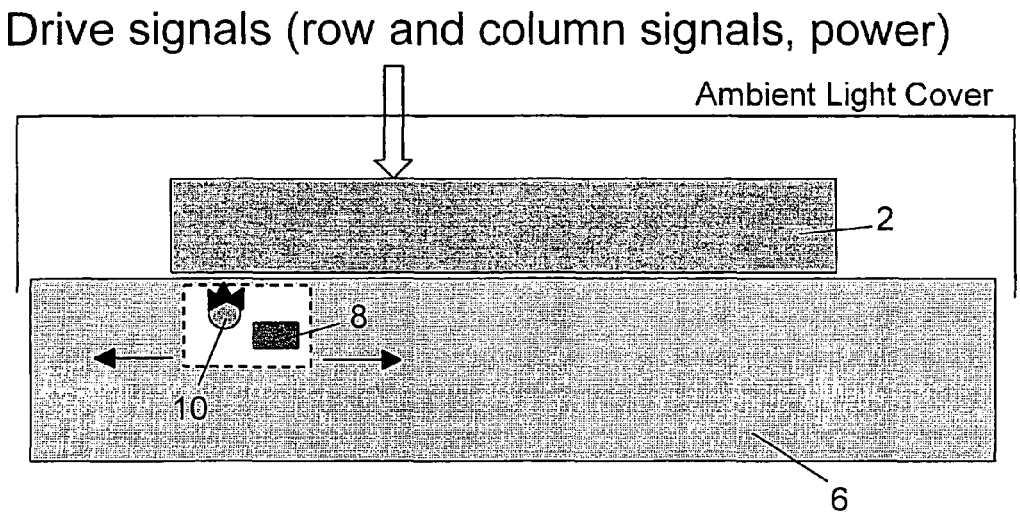
FIG. 3 illustrates a first embodiment of an image capturing device, the image capturing device comprising a flatbed scanner.

According to a first embodiment, as represented in FIG. 3, the matrix addressed display 2 is placed with its light emitting side against an image capturing device, for example is placed face down on a flat bed scanner 6. The flat bed scanner 6 may be a suitably modified document or film scanner. The spatial resolution (pixels/inch) of the scanner 6 is so as to allow for adequate vision of the individual pixels 4 of the display 2 under test, i.e. the spatial resolution is high enough to allow for precisely locating defective pixels. This spatial resolution is dependent on the algorithm used to extract the location of defective pixels. The sensor 8 and image processing hardware of the flat bed scanner 6 also have enough luminance sensitivity and resolution in order to give a precise quantisation of the luminance emitted by the pixels 4. For an emissive display 2, the light source 10 or lamp of the scanner 6 is switched off: the luminance measured is emitted by the display 2 itself. For a reflective type of display 2, the light source 10 or lamp of the scanner 6 is switched on: the light emitted by the display 2 is light from the scanner's light source 10, modulated by the reflective properties of the display 2, and reflected, and is subsequently measured by the sensor 8 of the scanner 6.

The output file of the image capturing device, in the embodiment described scanner 6, is an electronic image file giving a detailed picture of the pixels 4 of the complete electronic display 2.

Figure 4:
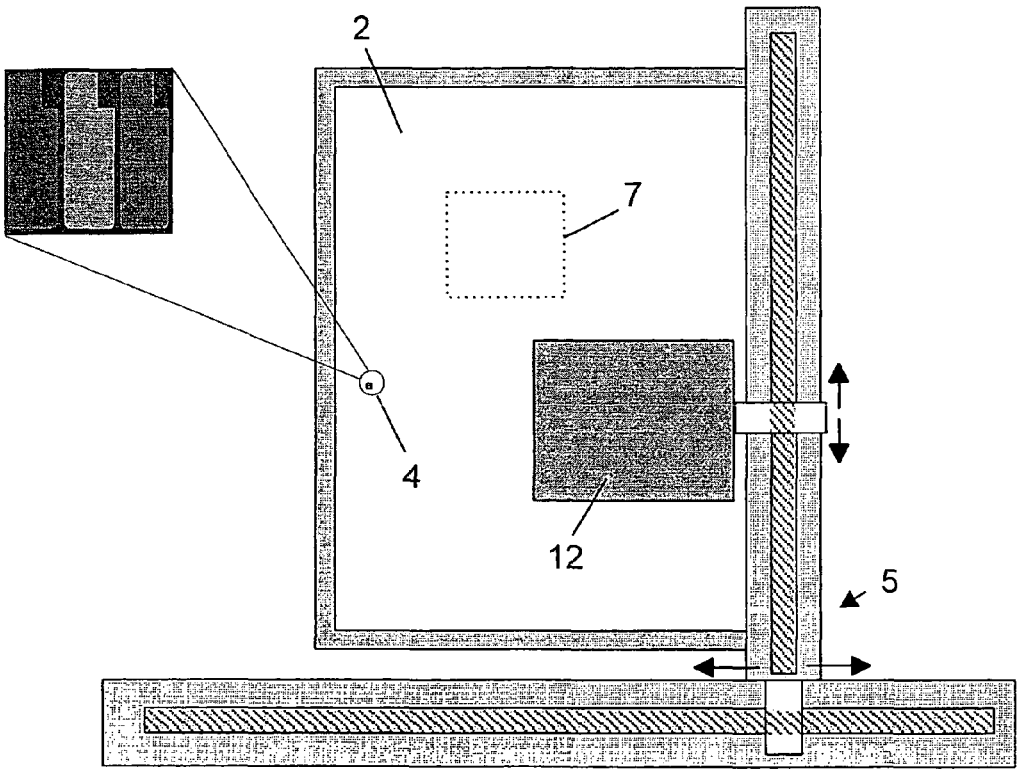
FIG. 4 illustrates a second embodiment of an image capturing device, the image capturing device comprising a CCD camera and a movement device.

According to a second embodiment of the vision measurement system, as illustrated in FIG. 4, an image capturing device, such as e.g. a high resolution CCD camera 12, which may be a colour camera or a monochrome camera, is used to take a picture of the pixels 4 of the display 2. The resolution of the CCD camera 12 is so as to allow to adequately define the individual pixels 4 of the display 2 to be characterised. In current state of the art of CCD cameras, it is not possible to image large matrix displays 2 at once. As an example, high resolution electronic displays 2 with an image diagonal of more than 20' require that the CCD camera 12 and the display 2 are moved with respect to each other, e.g. the CCD camera 12 is scanned (in X-Y position) over the image, surface of the display 2, or vice versa: the display 2 is scanned over the sensor area of the CCD camera 12, in order to take several pictures of different parts 7 of the display area 2. The pictures obtained in this way are thereafter preferably stitched to obtain one image of the complete active image surface of the display 2. A colour CCD-camera can be used to extract colour information on the pixels, but also a monochrome CCD-camera with added colour filters (for instance on a filter wheel) can be used.

Again, the resulting-electronic image file, i.e. the output file of the image capturing device, which is in the embodiment described a CCD camera 12, gives a detailed picture of the pixels 4 of the display 2 that needs to be characterised. An example of an image 13 of the pixels 4 of a matrix display 2 is visualised in FIG. 5*a*.

Once an image 13 of the pixels 4 of the display 2 has been obtained, a process is run to find the exact location of defective pixels 3*a*, 3*b* and to extract pixel charactersation data from the electronic image 13 obtained from the image capturing device 6, 12 to characterise these defective pixels 3*a*, 3*b*.

In a first step, the actual location of the matrix display pixels 4 is identified and related to the pixels of the electronic image 13, for example of the CCD or scanner image.

In matrix displays 2, individual pixels 4 can be separated by a black matrix raster 14 that does not emit light. Therefore, in the image 13, a black raster 15 can be distinguished. This characteristic can be used in the algorithms to clearly separate and distinguish the matrix display pixels 4. The luminance distribution on an imaginary line in a first direction, e.g. vertical line 16 in a Y-direction, and across an imaginary line in a second direction, e.g. horizontal line 18 in an X-direction, through a pixel 4 can be extracted using imaging software, as illustrated in FIG. 5*a* to FIG. 5*c*. Methods of extracting features from images are well known, e.g. as described in "Intelligent Vision Systems for Industry", B. G. Batchelor and P. F. Whelan, Springer-Verlag, 1997, "Traiternent de l'Image sur Micro-ordinateur", Toumazet, Sybex Press, 1987; "Computer vision", Reinhard Klette and Karsten Schluns, Springer Singapore, 1998; "Image processing: analysis and machine vision", Milan Sonka, Vaclaw Hlavac and Roger Boyle, 1998.

Supposing that the image generated by the matrix display 2 when the image was acquired by the image capturing device 6, 12 was set on all pixels 4 having a first value, e.g. all white pixels 4 or all pixels 4 fully on. Then the luminance distribution across vertical line 16 and horizontal line 18, in the image 13 acquired by the image capturing: device 6, 12, shows peaks 19 and valleys 21, that correspond with the actual location of the matrix display pixels 4, as shown in FIG. 5*b* and FIG. 5*c* respectively. As noted before, the spatial resolution of the image capturing device, e.g. the scanner 6 or the CCD camera 12, needs to be high enough, i.e. enough to allow precisely locating the matrix display pixels. Therefor, the resolution of the image capturing device may be higher than the resolution of the matrix display 2 (over-sampling). A lower degree of over-sampling is also possible. By using for instance optical filters, the required oversampling degree can further be decreased. Because of the over-sampling, it will be possible to express the horizontal and vertical distance of the matrix display pixels 4 precisely in units of pixels, of the image capturing device 6, 12 (not necessarily integer-numbers).

A threshold luminance level 20 is constructed that is located at a suitable value between the maximum luminance level measured at the peaks 19 and minimum luminance level measured at the valleys 21 across the vertical lines 16 and the horizontal lines 18, e.g. approximately in the middle. All pixels of the image capturing device 6, 12 with luminance below the threshold level 20 indicate the location of the black raster 15 in the image, and thus of a corresponding black matrix raster 14 in the display 2. These locations are called in the present description "black matrix locations" 22. The most robust algorithm will consider a pixel location of the image capturing device 6, 12 which is located in the middle between two black matrix locations 22 as the centre of a matrix display pixel 4. Such locations are called "matrix pixel centre locations" 24. Depending on the amount of over-sampling, an amount of image capturing device pixels located around the matrix pixel centre locations 24 across vertical line 16 and horizontal line 18, can be expected to represent the luminance of one matrix display pixel 4. In FIG. 5*a*, these image capturing device pixels, e.g. CCD pixels, are located in the hatched area 26 and are indicated with numbers 1 to 7 in FIG. 5*b*. These CCD pixels are called "matrix pixel locators" 28 in the following. The matrix pixel locators 28 are defined for one luminance level of the acquired image 13. To make the influence of noise minimal, the luminance level is preferably maximised (white flat field when acquiring the image).

Other algorithms to determine the exact location of the matrix display pixels 4 are included within the scope of the present invention. By means of example a second embodiment, which describes an alternative using markers, is discussed below.

A limited number of marker pixels (i.e. matrix display pixels 4 with a driving signal which is different from the driving signal of the other matrix pixels 4 of which an electronic image is being taken), for instance four, is used to allow precise localisation of the matrix display pixels 4. For example, four matrix display pixels 4 ordered in a rectangular shape, can be driven with a higher driving level than the other matrix display pixels 4. When taking an electronic image 13 of this display area, it is easy to determine precisely the location of those four marker pixels 4 in the electronic image 13. This can be done for instance by finding the four areas in the electronic image 13 that have the highest local luminance value. The centre of each marker pixel can then be defined as the centre of the local area with higher luminance. Once those four marker pixels have been determined, interpolation can be used to determine the location of the other matrix display pixels present in the electronic image. This can be done easily since the location of the other matrix display pixels is known relative to the marker pixels a priori (defined by the matrix display pixel structure).

An advantage of this algorithm compared to the one of the previous embodiment is that a lower degree of over-sampling is necessary since it is not necessary anymore to be able to isolate the black matrix in the electronic image. Therefore, lower resolution image capturing devices 6, 12 can be used. The algorithm can also be used for matrix displays where no black matrix structure is present or for matrix displays that also have black matrix between sub-pixels or parts of sub-pixels, such as a colour pixel for example.

After having determined the location of each individual matrix pixel 4, its luminance is calculated.

The luminance of the matrix pixel locators 28 across the X-direction and Y-direction that describe one pixel location, are averaged to one luminance value using a suitable calculation method, e.g. the standard formula for calculation of a mean. As a result, every pixel 4 of the matrix display 2 that is to be characterised is assigned a pixel value. (a representative or averaged luminance value). Other more complex formulae are included within the scope of the present invention: e.g. harmonic mean can be used, or a number of pixel values from the image 13 can be rejected from the mean formula as "outliers or noisy image capturing device pixels".

Figures 6, 7:
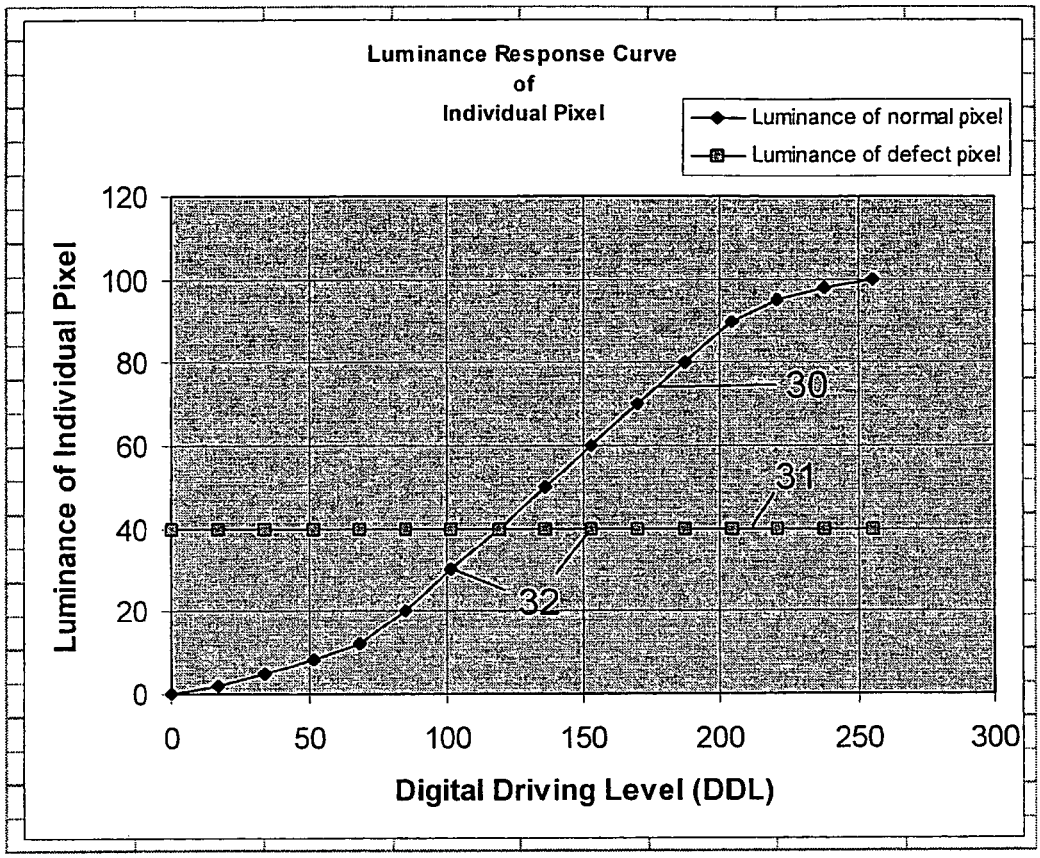
FIG. 6 shows an example of a luminance response, curve of a good and of a defective pixel, the curves being constructed using sixteen characterisation points.
FIG. 7 illustrates defining classes of pixels to locate and characterise defect pixels.
Figure 8:
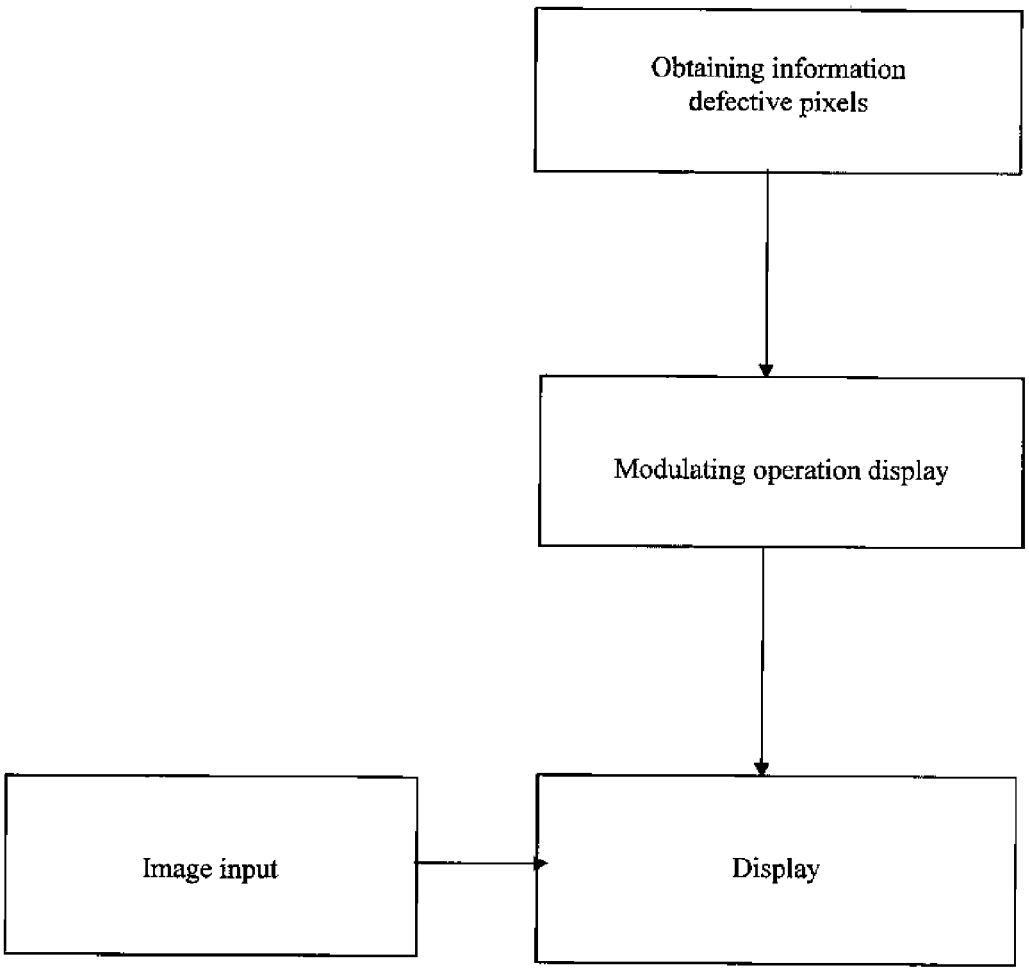
FIG. 8 illustrates a flow diagram of the method for avoiding misinterpretation an image, displayed on a display.

It will be well understood by people skilled in the art that the luminance of the individual pixels 4 can be calculated in any of the described ways or any other way for various test images or luminances, i.e. for a plurality of test images in which the pixels are driven by different driving levels. Supposing that, in order to obtain a test image, all pixels are driven with the same information, i.e. with the same drive signal or the same driving level, then the displayed image represents a flat field with luminance of the pixels ranging from black to white depending on the drive signal. For each percentage of drive between 0% (zero drive, black-field) and 100% (full drive or white field) a complete image 13 of the matrix display 2 under test can be acquired, and the luminance of each individual pixel 4 can be calculated from the acquired image 13 with any of the described algorithms or any other suitable algorithm. If all response points (video level vs. luminance level) of a given pixel i are then grouped, then the luminance response function of that given pixel i is obtained. The response function may be represented by a number of suitable means for storage and retrieval, e.g. in the form of an analytical function, in the form of a look-up table or in the form of a curve. An example of such a luminance response curve 30 is illustrated in FIG. 6. An example of a luminance response curve 31 of a defective pixel is also illustrated in FIG. 6. The luminance response curve of a defective pixel has-substantially the same luminance level for any drive level.

The luminance response function can be constructed with as many points as desired or required for evaluating the rules that define defective pixels. The curves 30, 31 in the example of FIG. 6 are constructed using sixteen characterisation points 32, which result from the display and acquisition of images, and the calculation of luminance levels for a given pixel 4.

It is to be remarked that a luminance response function is thus available for every individual pixel 4 of the matrix display 2 to be characterised. The luminance response functions of individual pixels 4 may all be different or the response functions may be reduced to a smaller number of typical or representative functions, and leach pixel may be assigned to one of these typical functions.

For modern colour liquid-crystal displays (LCDs) with a resolution up to three million pixels, each pixel e.g. composed, of a number of colour sub-pixels such as red, green and blue sub-pixels, this means 9 million functions, are obtained, each defined by a set of e.g. sixteen-values (luminance in function of drive level). If a sub-pixel becomes stuck in one state the result is a colour shift for that pixel. This can be identified by carrying out the characterisation of each pixel on a single colour basis. That is all the red sub-pixels are switched on, viewed and analysed, followed by all the blue and all the green.

The luminance response of the individual (sub)pixels 4 completely describes that pixel's luminance behaviour as a function of the applied drive signal. By examining this luminance behaviour, defective pixels can be localised, bearing in mind the rules that define the defective pixels. The luminance response of a defect pixel may be for instance a substantially constant value, independent of the level of the drive signal, as shown by curve 31 in FIG. 6. Alternatively, the luminance response of a defect pixel may for example have values that are substantially higher or lower than the values of the luminance responses of non-defective pixels in the neighbourhood of the defective pixel.

In a second step, the behaviour of the defect (sub)pixels 3*a*, 3*b* is characterised.

Figure 2:
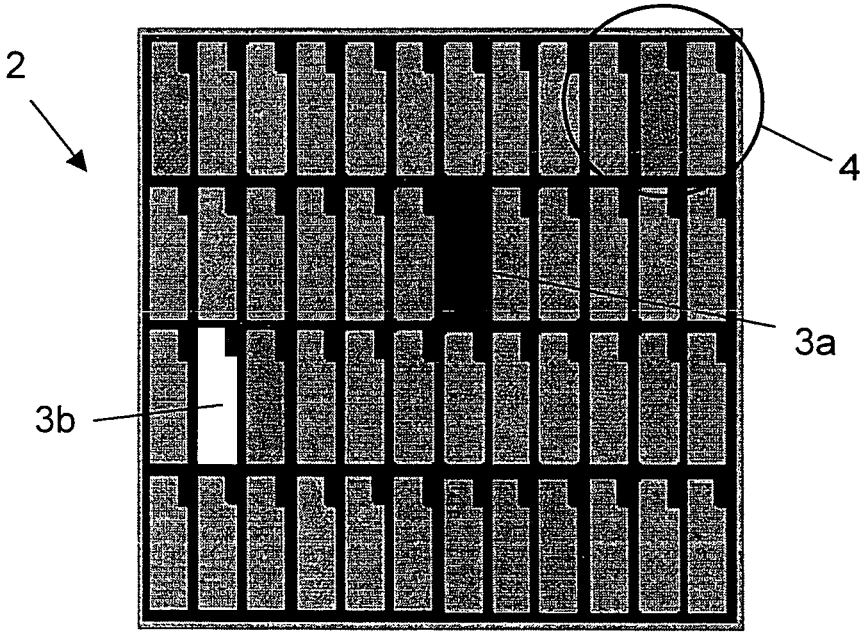
FIG. 2 illustrates a grey scale LCD based matrix display having two defect sub-pixels.

A defective pixel 3*a*, 3*b* can be characterised by following attributes:

- a location: a row and column number and possibly a subpixel index that indicates which subpixel(s) is (are) defect. The subpixel index is only applicable if the pixel is composed out of a number (typically 3) of subpixels (for instance R, G, and B for colour or A, B and C for monochrome), as represented in FIG. 2.
- an identification for the rule that defined this pixel as being defective
- one or more-digital driving levels (DDL) that describe the corresponding luminance/colour of the defect (sub)pixels. The number of DDL's needed can be dependent on the rule that was used.

For example: a pixel with location (320,334) has two defect subpixels (A and C) that have a luminance behaviour corresponding to DDL (16 and 111).

Other algorithms are also possible. One such other algorithm is described below as an example.

The same setup (CCD-camera or scanner) as described before can be used. Instead of driving all pixels of the display with the same driving signal and using (severe) over-sampling to locate the pixels of the matrix display, one can drive the pixels in groups requiring less resolution. For instance four classes of pixels can be defined: class A that groups all pixels in the even columns and even rows of the displays class B that groups all pixels in even columns and odd rows of the display, class C that groups all pixels in the odd columns and even rows of the display and class D that groups all pixels in the odd rows and odd columns of the display. This is illustrated in FIG. 7.

All pixel classes can then be driven separately, resulting in less resolution requirements. The classes that are "not driven" can be set to a fixed or chosen DDL. For instance if class A is driven with DDL=255, all other classes can be driven with DDL=0 to be able to easily locate the pixels of class A from the resulting CCD-camera or scanner image. The size of the classes can be chosen at will (from 1 pixel/class to all display pixels in a single class). Suppose one has classes that hold only a single pixel, then a CCD-camera with very low resolution will be sufficient.

All information on defect pixels of the display may be stored in a database. This database will be called in the present description "display characteristics data".

Information on defective pixels can be entered in the database in any of two ways:

- the manufacturer of the display (or a service center) extracts information on the defective pixels and updates the "display characteristics data", or
- the user of the display updates the "display characteristics data" based on his visual perception.

In the first case, the manufacturer can test the display with a reliable vision system that extracts information on defective pixels, for example a vision system as described above. This information is stored in the "display characteristics data" and may be supplied to the customer as a kind of quality certificate.

In the second case, the user of the display can update the "display characteristics data" for example by means of a graphical user interface. The graphical user interface can show a number of test-images on the display that allow the user to easily locate defective pixels. If the user detects new defective pixels then he can enter the location of these defective pixels (for instance by means of a pointing device such as e.g. a mouse, a cursor or an optical pointing device. Once the defective pixels have been located, a new series of test-images will allow the user to identify the characteristics of the defect. These characteristics then are saved into the database for each defective pixel of the display.

According to a first embodiment of the present invention, based on the "display characteristics data" information can be supplied to the user of the display on a data storage device such as a diskette or a CD-ROM for example. This can be done in several ways, for example:

- The user can explicitly ask to display the defective pixels on the screen, or to give information about the defective pixels, for example by pressing a button. In this case, software algorithms can mark the defective pixels visually on the screen or can display a report in any desired format that gives the desired information. This can be done during actual display of an image or when no image is displayed.

A number of triggers can cause this information to be displayed automatically. These triggers can be very simple, for example the launch of a certain program (for instance a radiologic image viewer). Also more complex triggers are possible: one example is that a defective pixel is visually marked on the screen, e.g. by adapting the image content of pixels in the neighbourhood of a defective pixel, such as for example by making its neighbouring pixels blink, when the defective pixel is in the current area of interest of a radiologic viewer that is active at that moment, which area of interest may be indicated by means of a pointing device such as a mouse or by a touch screen for example. Also this automatic display of defective pixel information may be done, but does not need to be done, during actual displaying of an image.

Of course, a graphical user interface can be provided which will make it possible to easily manage these triggers actions. Another possibility is using, command-line options or configuration files.

According to a second embodiment of the present invention, defective pixels of the matrix display are indicated on an electronic copy of the displayed image.

According to another embodiment of the present invention, for liability reasons, defects of the matrix display may always be recorded with any copy of an actually displayed image going to be stored. In that case, at any moment in time, anyone is always able to see what has actually been seen on the display. This may be of importance for example in the medical world, where a doctor may make a diagnosis based on the displayed images.

According to a further embodiment of the present invention, the information about defective pixels can also be used to take a number of corrective actions to avoid image misinterpretation. By corrective actions is meant performing certain actions that changes the current state of the display image to a state were there is no (less) risk of image misinterpretation.

Some examples will make this more clear

It is supposed that a defective pixel is in the current area of interest of a medical image viewer. Then the corrective action could be to automatically shift the image to the left, right, up or down until the defective pixel is no longer in the region of interest.

Defective pixels are especially risky when they occur in an image area were much image transition occurs (no flat image area). Then the corrective action could be shifting the image in such a way that the defect pixel(s) will be in a flat image area.

Instead of immediately performing corrective actions, a user can also select the desired action from a list that can be displayed.

Of course any combination of corrective actions and displaying of image information is also possible and can be configured with the graphical user interface or by command-line options or configuration files.

It is to be understood that although preferred embodiments, specific constructions and configurations have been discussed herein for devices according to the present invention, various changes or modifications in form and detail may be made without departing from the scope and spirit of this invention.

The invention claimed is:

1. Method for avoiding misinterpretation of an image displayed on a matrix display device due to defective cells in the matrix display device, whereby the image comprises a plurality of pixels, the method comprising:

obtaining information on the presence and the location of the defective cells in said matrix display device, and on the basis of this information, modulating the operation of said matrix display device when displaying said image on said matrix display device and adapting in this way the image content of the pixels of said image, corresponding to said defective cells or corresponding to the pixels in the neighborhood of said defective cells so as to emphasize or warn for the presence of said defective cells on the actual display of said image.

2. Method according to claim 1, wherein the information is obtained from data previously stored in a memory device.

3. Method according to claim 2, comprising, while displaying the image on the matrix display device, supplying information on defective cells to a user, based on the stored data.

4. Method according to claim 1, wherein, emphasizing or warning for the presence of at least one defective cell comprises visually marking the at least one defective cell on said matrix display device.

5. Method according to claim 1, furthermore comprising shifting the displayed image so that defective cells are not located in a region of interest.

6. Method according to, claim 1, furthermore comprising shifting the displayed image so that a defective cell is located in a flat image area.

7. Method according to claim 1, wherein the information on the presence of defective cells is obtained by means of an image capturing device.

8. Method for avoiding misinterpretation of a copy of an image displayed on a matrix display device due to defective cells in the matrix display device, whereby the copy of the image comprises a plurality of pixels, the method comprising:

obtaining information on the presence and the location of the defective cells in said matrix display device, and on the basis of this information, adapting in said copy of said image, the image content of the pixels corresponding to said defective cells or of the pixels corresponding to the cells in the neighborhood of said defective cells so as to emphasize or warn for the presence of pixels corresponding to said defective cells, thereby avoiding misinterpretation of the copy of the image displayed on the matrix display device due to said defective cells.

9. Method according to claim 8, wherein, the copy is a hard copy or an electronic copy.

10. An apparatus for avoiding misinterpretation of an image displayed on a matrix display device due to defective cells in the matrix display device, whereby the image comprises a plurality of pixels, the device comprising:

an information retrieval device for obtaining information on the presence and the location of the defective cells in said matrix display device, and a modulating device using this information for modulating the operation of said matrix display device when displaying said image on said matrix display device and adapting in this way the image content of the pixels of said image, corresponding to said defective cells or corresponding to the pixels in the neighborhood of said defective cells so as to emphasize or warn for the presence of said defective cells on the actual display of said image.

11. An apparatus according to claim 10, wherein the information retrieval device comprises a memory device where defective cell information data is stored.

12. An apparatus according to claim 11, comprising an information supply device for supplying information on defective cells to a user, based on the stored data, while displaying the image on said matrix display device.

13. An apparatus according to claim 10, furthermore comprising marking means for visually marking the defective cells on said matrix display device.

14. An apparatus according to claim 10, furthermore, comprising a shifting device for shifting the displayed image so that defective cells are not located in a region of interest.

15. An apparatus according to claim 10, furthermore comprising a shifting device for shifting the displayed image so that a defective cell is located in a flat image area.

16. An apparatus for avoiding misinterpretation of a copy of an image displayed on a matrix display device due to defective cells in the matrix display device whereby the copy of the image comprises a plurality of pixels, the device comprising:

an information retrieval device for obtaining information on the presence and the location of the defective cells in said matrix display device and a modulating device using this information for adapting in said copy of said image, the image content of the pixels corresponding to said defective cells or of the pixels corresponding to the cells in the neighborhood of said defective cells so, as to emphasize or warn for the presence of pixels corresponding to said defective cells, thereby avoiding misinterpretation of the image displayed on the matrix display device due to said defective cells.

17. A control unit for use with an apparatus for avoiding misinterpretation of an image displayed on a matrix display device, due to defective cells in the matrix display device and whereby the image comprises a plurality of pixels, the control unit being adapted for controlling the obtaining of information on the presence, the location and characteristics of the defect cells in said matrix display device, and for controlling, on the basis of this information, modulation of the operation of said matrix display device when displaying said image on said matrix display device and adapting in this way the image content of the pixels of said image, corresponding to said defective cells or corresponding to the pixels in the neighborhood of said defective cells so as to emphasize or warn for the presence of said defective cells on the actual display of said image, or, in a copy of said image, for adaption of the image content of the pixels corresponding to said defective cells or of the pixels corresponding to the cells in the neighborhood of said defective cells so, as to emphasize or warn for the presence in the copy of said image of pixels corresponding to said defective cells, thereby avoiding misinterpretation of the image displayed on the matrix display device, due to said defective cells.

* * * * *